US006731258B2

(12) United States Patent
Lin et al.

(10) Patent No.: US 6,731,258 B2
(45) Date of Patent: May 4, 2004

(54) FAST-WORKING LCD RESIDUAL DISPLAY SUPPRESSION CIRCUIT AND A METHOD THERETO

(75) Inventors: Ji-Zoo Lin, Hsinchu (TW); Yung-Peng Hwang, Taipei (TW)

(73) Assignee: Winbond Electronics Corp., Hsinchu (TW)

( * ) Notice: Subject to any disclaimer, the term of this patent is extended or adjusted under 35 U.S.C. 154(b) by 299 days.

(21) Appl. No.: 10/029,033

(22) Filed: Dec. 18, 2001

(65) Prior Publication Data

US 2003/0020676 A1 Jan. 30, 2003

(30) Foreign Application Priority Data

Jul. 24, 2001 (TW) ..... 90118067 A

(51) Int. Cl.[7] ..... G09G 3/36

(52) U.S. Cl. ..... 345/87; 345/210; 345/211; 345/212; 345/213; 345/214; 345/215; 345/87; 345/90; 345/98; 345/204; 315/200 R; 315/291; 315/326; 323/205; 323/242; 323/288; 323/370; 378/118

(58) Field of Search ..... 345/210–215, 345/87, 90, 98, 204; 315/200 R, 291, 326; 323/205, 242, 288, 370; 378/118

(56) References Cited

U.S. PATENT DOCUMENTS 5,572,735 A * 11/1996 Tanikawa ..... 345/211
6,359,391 B1 * 3/2002 Li ..... 315/291
6,476,591 B2 * 11/2002 Yamaguchi et al. ..... 345/211
2002/0110219 A1 * 8/2002 Yagi ..... 378/118
2002/0145577 A1 * 10/2002 Lin et al. ..... 345/87

* cited by examiner

*Primary Examiner*—Bipin Shalwala
*Assistant Examiner*—David L Lewis
(74) *Attorney, Agent, or Firm*—Ladas & Parry

(57) ABSTRACT

The invention relates to a fast-working residual display suppression circuit for LCD and a method thereto. The method includes the following steps: receiving a control signal; if the control signal is an automatic control signal, comparing a first reference voltage with a fixed difference to a supply voltage to a second reference voltage according to an externally input start signal; as the first reference voltage≦the second reference voltage, outputting an activating signal to an LCD power controller and a fast discharge circuit; if the control signal is a manual control signal, directly outputting the activating signal in order to drive the LCD power controller and the fast discharge circuit and cutting off the power supply to the fast discharge circuit by the LCD power controller according to the activating signal and combining two discharge paths of the fast discharge circuit to produce an optimal discharge path to speed up the discharge rate.

16 Claims, 9 Drawing Sheets

FAST-WORKING LCD RESIDUAL DISPLAY SUPPRESSION CIRCUIT AND A METHOD THERETO

BACKGROUND OF THE INVENTION

1. Field of the Invention

This invention relates to a processing circuit and method for a liquid crystal display (LCD), especially to a fast-working residual display suppression circuit for LCD and a method thereto, suitable to be applied to a cellular phone.

2. Description of the Related Art

In a liquid crystal control panel circuit, this type ofs a Super Twiist Nematic (STN) liquid crystal panel, a voltage generation circuit produces different driving voltages (for example, V1, V2, V3, V4 and V5). The variation of a voltage source VDD and the different driving voltages at different times is used to create different brightness levels on a liquid crystal panel in order to present visual information. FIG. 1 depicts a schematic diagram of a typical LCD voltage generation circuit and a stable capacitor Cs thereof. In FIG. 1, each of the pixel driving voltages (V1, V2, V3, V4 and V5) is applied through a stable capacitor (Cs1-Cs5) to stabilize the respective driving voltage (i.e., for V1, V2, V3, V4 or V5) output. However, in the structure shown in FIG. 1, at the power source VDD powered off, these stable capacitors Cs can provide residual power to the circuit due to the residual charge, causing the display of a residual display until the residual charge sinks to a voltage low enough to influence on the visual effect. The residual display is more severe when the current LCD circuits are designed for low power consumption. In LCD power generation circuit design, there are two methods for this.

First, the LCD driving voltages V1, V2, V3, V4 and V5 are changed depending on the power source VDD for the digital control signal. In this type of design, the power-off speed has a positive orientation to the power-down speed of VDD, as with the timing shown in FIG. 2. During the period of $t_H$, the VDD level is gradually decreased by discharge from the power-off so that the voltages of the column and row terminals SEGs and COMs on the LCD panel and the driving voltages V1, V2, V3, V4 and V5 change to 0V. The digital control signals DIGs on the terminals SEGs and COMs will distort with respect to these decreased voltages. Therefore, using this type ofn LCD, for example, Solomon's LCD driving IC, may create the residual display due to control signal distortion, as well as its driving voltage changing with VDD. Accordingly, an extra voltage regulator is used to eliminate the change of the driving voltages V1–V5 influenced by the VDD variation.

Second, the voltages V1–V5 are designed to respectively maintain a fixed voltage difference to the voltage VDD when the VDD is over a desired operating voltage. For example, in Epson's LCD driving IC, a voltage regulator circuit 31, as shown in FIG. 3, is added to maintain the signals at power-off. In FIG. 3, the voltage regulator circuit 31 includes an amplifier OP, an adjustable stable reference voltage device REF and an adjustable gainer. The amplifier OP controls the output voltage V5, using the reference voltage level from the device REF and the gain factor from the adjustable gainer consisting of the resistors R1 and R2, to a fixed difference between the voltages V5 and Vdd. At power-off, this type of LCD power voltage generation circuit can maintain the voltages V1–V5 by a voltage regulator. At this point, the residual display will become more severe if no any control signal is added. Therefore, an added control signal is critical for this type of circuit at power-off, so that the circuit has a period of time $t_H$ to discharge the voltages V1–V5 and clear the input of the signals SEGs and COMs. At this point, because the voltage VDD still exists (i.e., the substantial power-off is not complete), all digital control signals DIGs can function normally. The duration of the power-off for VDD is $t_R$. As such, the signal will not distort after the power-off. However, the response time is longer, by $t_R+t_H$, compared to the first.

Accordingly, another circuit is shown in FIG. 5. In FIG. 5, the circuit can quickly avoid residual display without additional response time. As shown in FIG. 5, the circuit detects the start signal by a detection circuit 51. When the circuit (PD=Low) is started and the respectively stable capacitors with respect to the voltages V1 to V5 are charged completely (Start_up=Low), the detection circuit is started. After the start, a comparator 52 is used to compare a reference voltage VREF from a reference voltage source 53 and another reference voltage VSS in order to detect the power-off presentation. Another reference voltage can be a grounding voltage or a reference voltage input by a user. In the case of presenting the power-off and the lower reference voltage VREF than the reference voltage VSS, as shown in FIG. 6, when the VDD just begins to be pulled down, the difference of VDD to V1, V2, V3, V4 and V5, respectively, is maintained at a constant by the voltage regulator circuit. When the VDD is reduced to a certain level, a power-off action other than a noise presentation is detected. At this point, a one-shot control circuit 54 in FIG. 5 activates a discharge circuit 56 to release the LCD residual charge so as to eliminate the residual display. However, this is disadvantageous in that the discharge time is prolonged by continuously powering of the voltage V1 to V5 and discharge performance is poor when V5>VSS.

SUMMARY OF THE INVENTION

Therefore, an object of the invention is to provide a fast-working residual display suppression circuit for LCD.

Another object of the invention is to provide a fast-working residual display suppression method, with both manual and automatic operability.

To realize the above and other objects, the invention provides a fast-working residual display suppression circuit for LCD and a method thereto. The fast-working LCD residual display suppression method includes the following steps. A control signal is received. If the control signal is an automatic control signal, a first reference voltage with a fixed difference to a supply voltage is compared to a second reference voltage according to an externally input start signal. As the first reference voltage≦the second reference voltage, an activating signal is output to an LCD power controller and a fast discharge circuit to quickly eliminate LCD residual display. Also, if the control signal is a manual control signal, the activating signal is directly output to drive the LCD power controller and the fast discharge circuit to quickly eliminate LCD residual display. As such, according to the activating signal, the LCD power controller cuts off the power supply to the fast discharge circuit and combines two discharge paths of the fast discharge circuit to produce an optimal discharge path to speed the discharge rate.

The fast-working residual display suppression circuit for LCD includes: a manual selector for outputting a manual control signal; an automatic detection circuit for automatically detecting the power state and output an automatic control signal; a selection switch for eliminating residual display and outputting an activating signal according to either the manual signal or the automatic signal; a signal level conversion circuit for receiving the activating signal and producing the desired voltage level output; a fast discharge circuit for quickly eliminating LCD residual display based on the activating signal and the desired voltage level output; and an LCD power controller for cutting off the power supplied to the fast discharge circuit based on the activating signal to speed up the discharge rate.

BRIEF DESCRIPTION OF THE DRAWINGS

The invention will become apparent by referring to the following detailed description of a preferred embodiment with reference to the accompanying drawings, wherein.

DETAILED DESCRIPTION OF THE INVENTION

Figure 1:
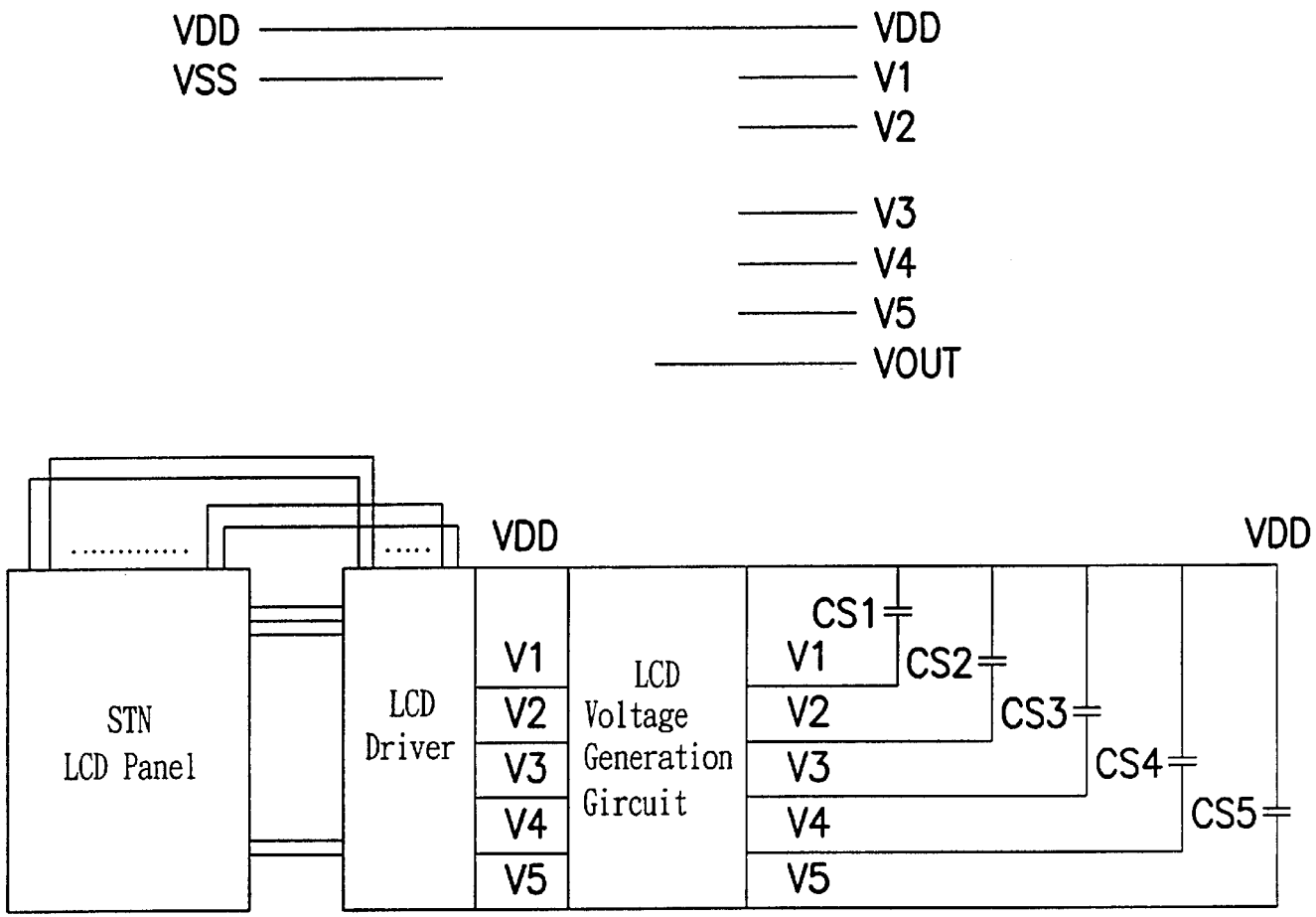
FIG. 1 (PRIOR ART)
FIG. 1 is a diagram of a conventional power voltage system.
Figure 2:
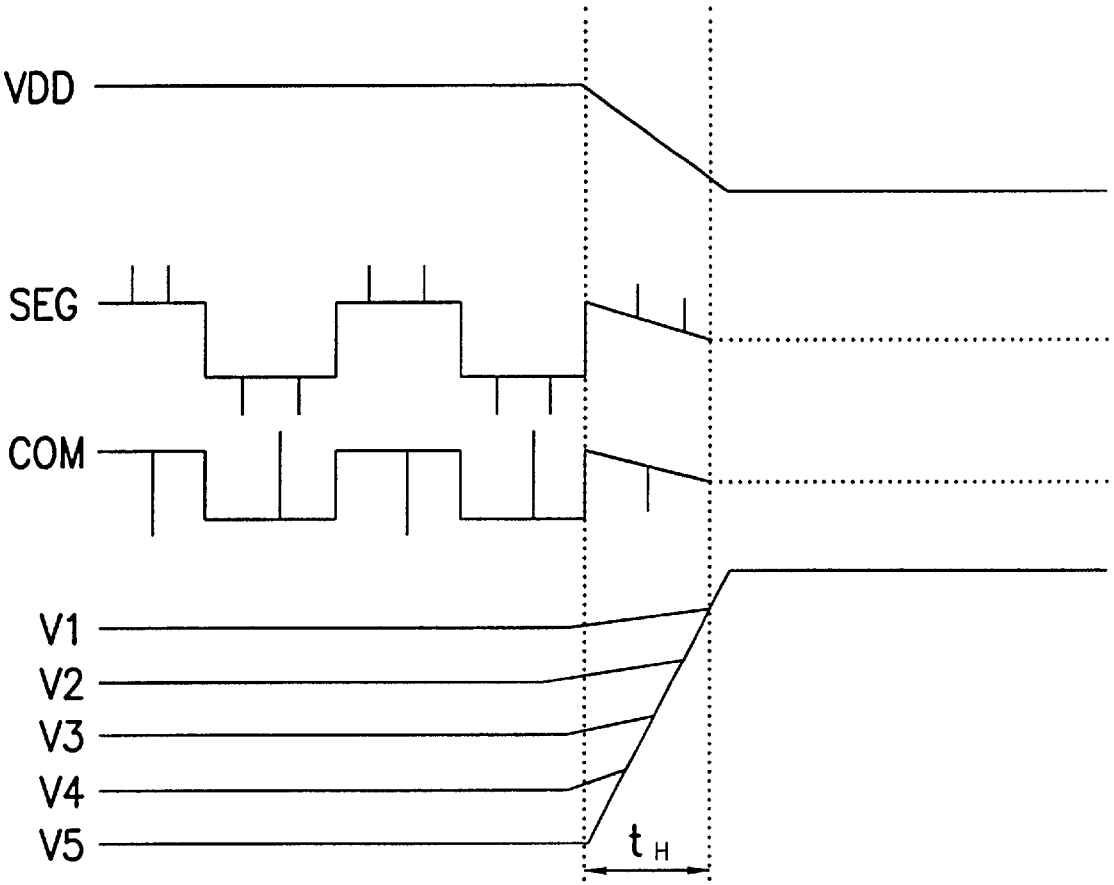
FIG. 2 (PRIOR ART)
FIG. 2 is a power-off timing for LCD power voltages V1 to V5 in FIG. 1 decreasing with VDD.
Figure 3:
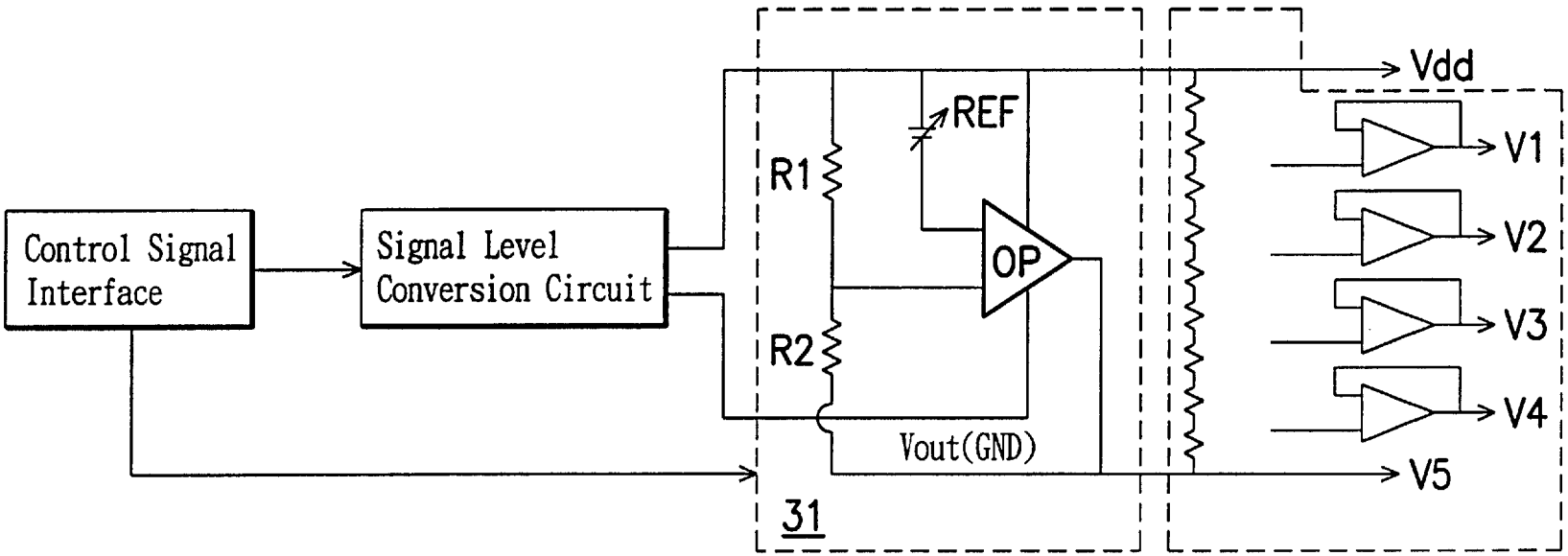
FIG. 3 (PRIOR ART)
FIG. 3 is a diagram of another conventional power voltage system.
Figure 4:
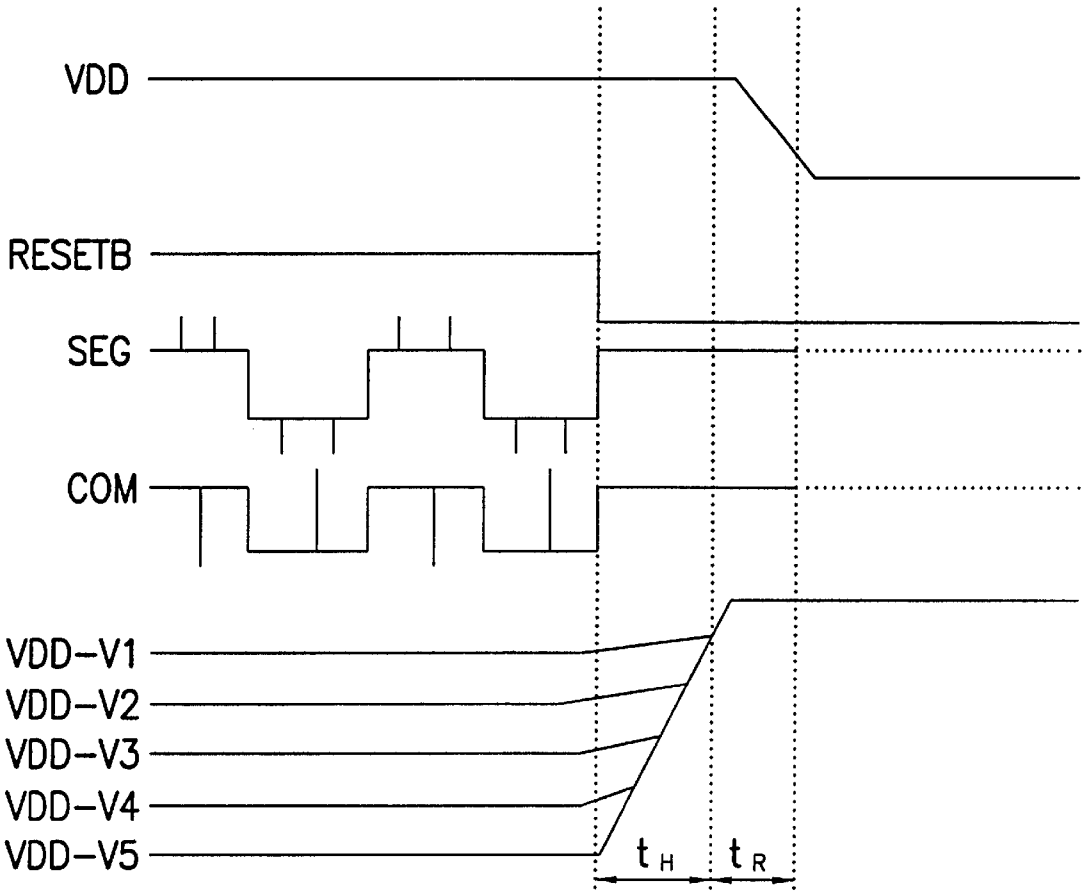
FIG. 4 (PRIOR ART)
FIG. 4 is a power-off timing for LCD power voltages V1 to V5 in FIG. 3 not decreasing with VDD.
Figure 5:
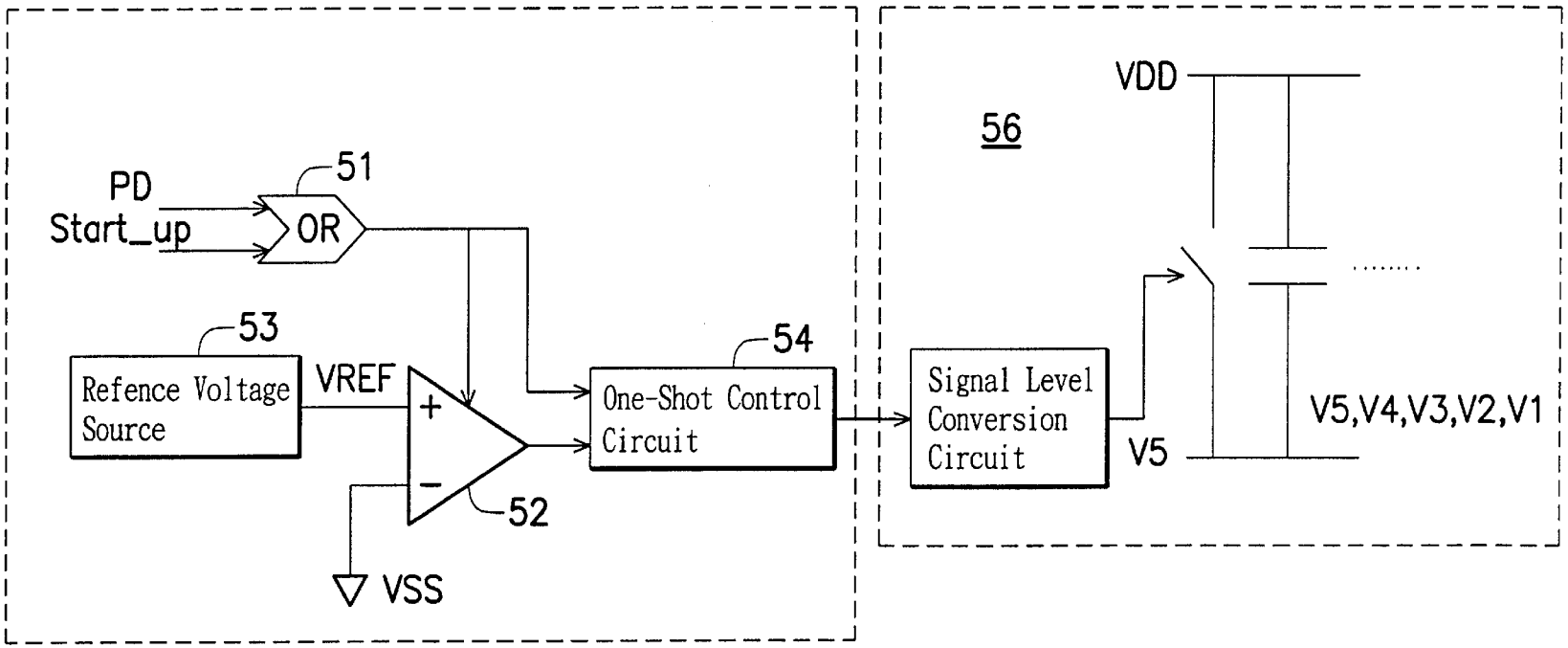
FIG. 5 (PRIOR ART)
FIG. 5 is a schematic diagram of another conventional power voltage system.
Figure 6:
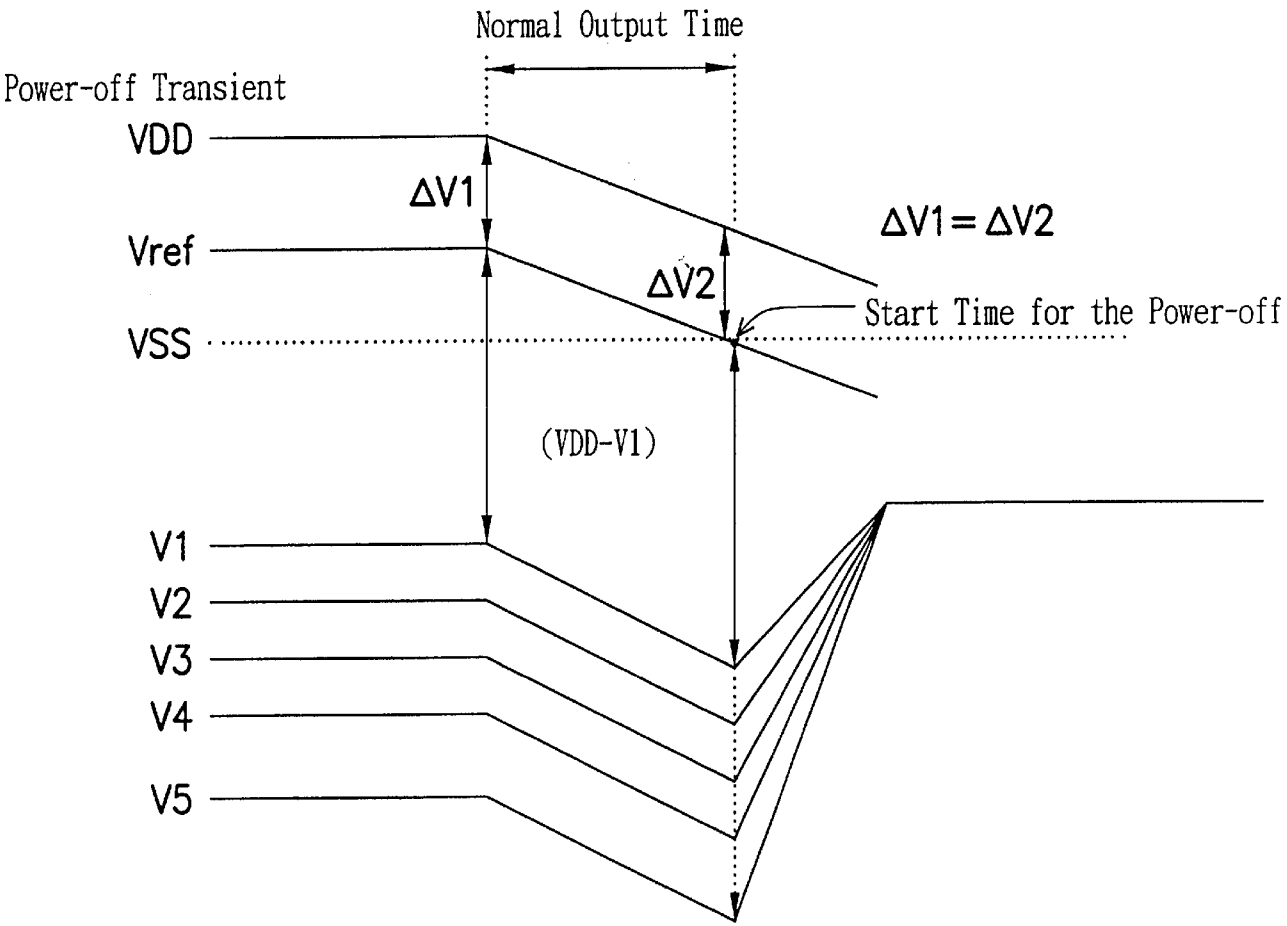
FIG. 6 (PRIOR ART)
FIG. 6 shows a relationship diagram of all voltages of FIG. 5 on the power-off.
Figure 7:
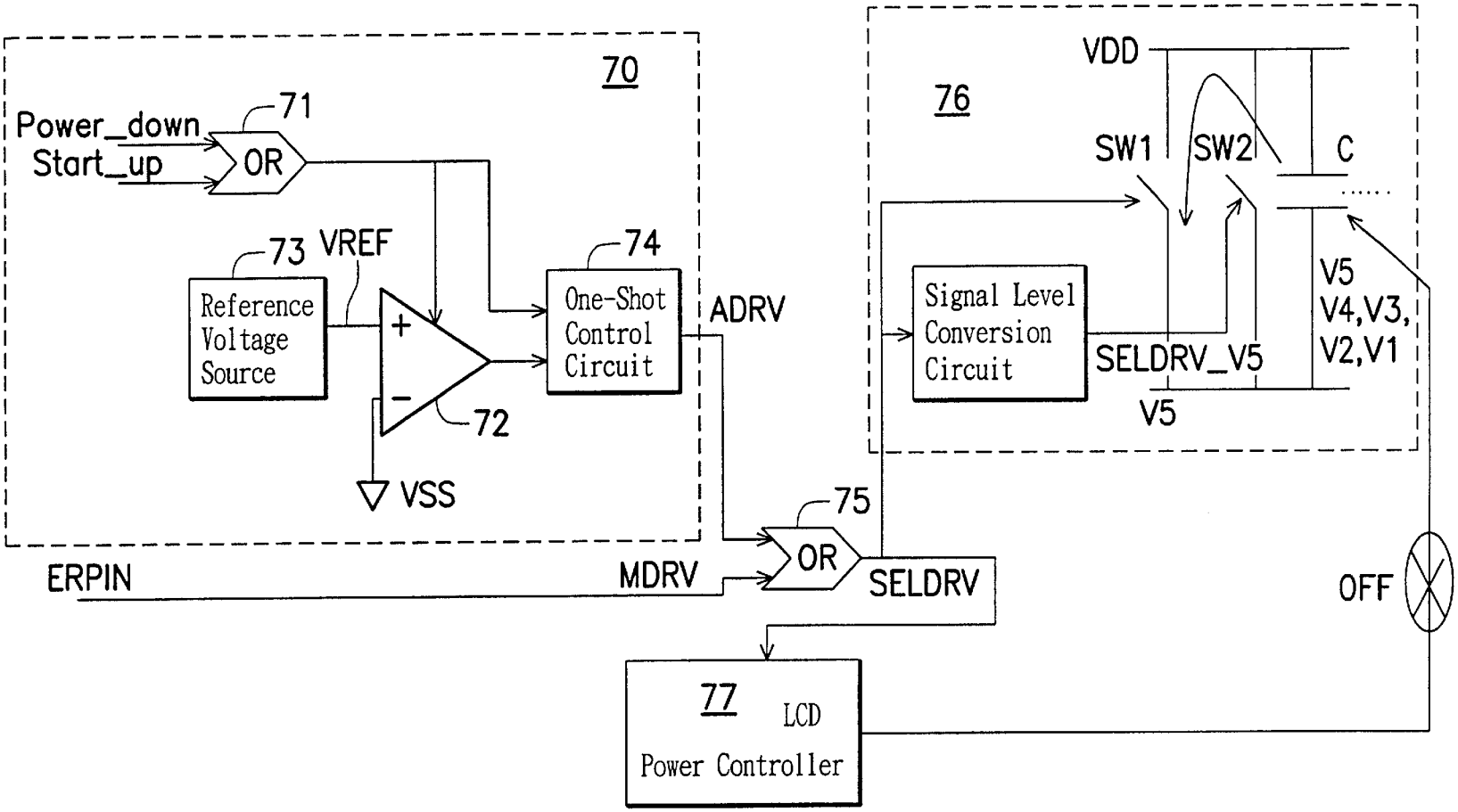
FIG. 7 shows a schematic diagram of an inventive fast residual display suppression circuit.

FIG. 7 is a schematic diagram of the inventive circuit, from the improvement of FIG. 5. In FIG. 7, the circuit includes: a manual selector ERPIN, an automatic detection circuit 70, an OR gate 75, a fast discharge circuit 76 and an LCD power controller 77. The manual selector can be an external control signal ERPIN for inputting a manual control signal MDRV to the OR gate 75. The automatic detection circuit 70 is identical to the portion 50 of FIG. 5, including a detection circuit 71 for detecting a start signal. The detection circuit 71 can be an OR gate used to start the automatic detection circuit 70 when not reaching actual power-off to the entire circuit (i.e., Power_down=low) and appearing in the stable state on the stable capacitor (i.e., Start_up=low). The circuit 70 after starting uses a comparator 72 to compare a reference voltage VREF from a reference voltage source 73 with another reference voltage VSS so as to automatically detect the power-off action. The reference voltage VSS can be a grounding voltage or a reference from a user. As the power-off action appears and the reference VREF is lower than the reference voltage VSS, a one-shot control circuit 74 outputs an automatic control circuit ADRV. According to the manual or automatic signal, the OR gate 75 eliminates the residual display and outputs an activating signal SELDRV. The fast discharge circuit 76 implements two switches SW1 and SW2 between VDD and V5 based on the SELDRV. As such, the two switches are respectively controlled by the activating signal SELDRV and a control signal SELDRV_V5 with a grounding voltage of V5 after passing through a signal level conversion circuit. Therefore, the residual charge on the capacitor C can quickly eliminate LCD residual display through the smallest impedance path of the two switches. For example, when V5 is close to VDD, the SW2 discharge path performance becomes lower. At this point, the SW1 path controlled by a signal from VDD to VSS is used as the optimal path to speed up the discharge rate when VDD>V5>VSS. The two switches can be any active device, this type ofs MOS. Further, the LCD power controller 77 cuts off the power supply to the fast discharge circuit based on the activating signal SELDRV to speed up the discharge rate at the same time.

Figure 8:
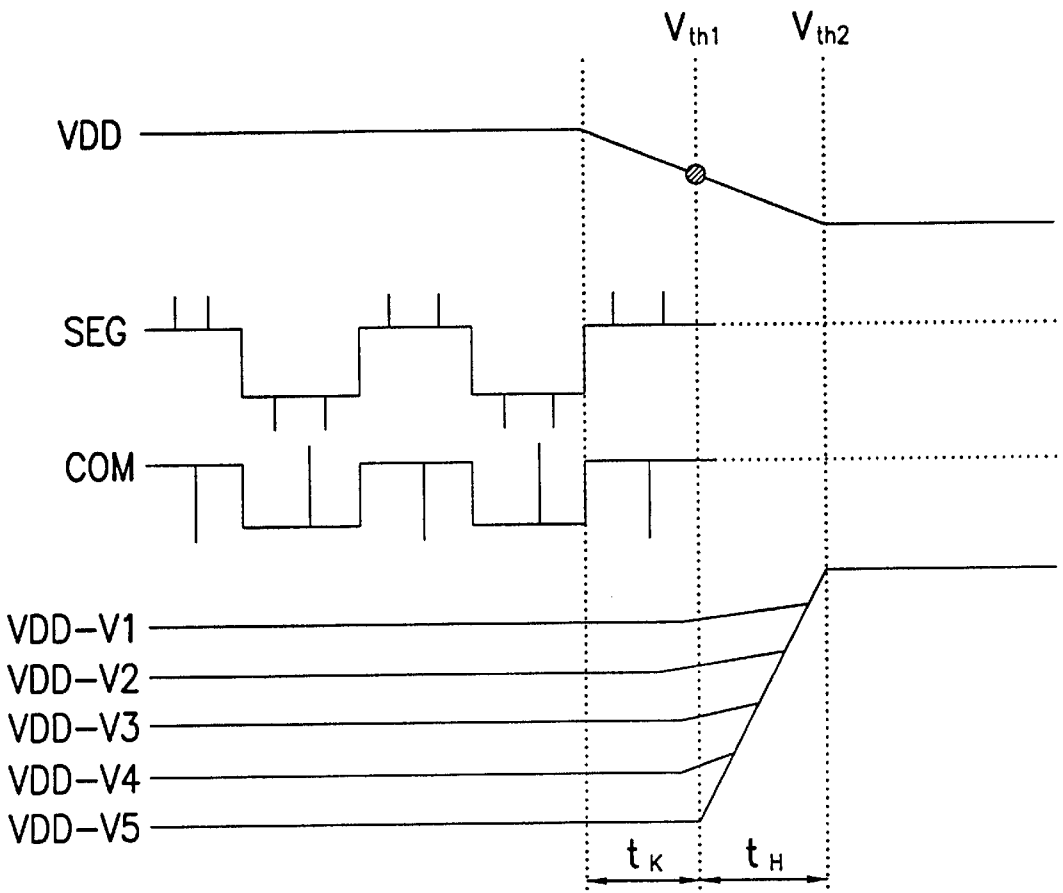
FIG. 8 is a timing of FIG. 7.

FIG. 8 is an operating flowchart of the automatic detection circuit portion of FIG. 7. As shown in FIG. 8, when the source VDD just pulls down, the difference between VDD and V1–V5, respectively, is unchanged so as to keep the signal in normal display. After passing through the time $t_K$, the source VDD reduces to the power-off detecting threshold $Vth_1$ detected by the circuit 70. The controller 77 cuts off the power supply to the capacitor and starts the discharge. At this point, the capacitor will discharge through the smallest impedance one of two switches until the time $t_H$ passes through and the voltage is as lower as the LCD panel's threshold $Vth_2$. For example, when starting the discharge, i.e., VSS>V5, the capacitor C discharges mainly through the switch SW2. When V5 is close to VSS, the discharge performance through SW2 becomes poor and thus the SW1 path controlled by the signal from VDD to VSS takes over the discharge function of SW2 when VDD>V5>VSS. Accordingly, discharge performance and rate are increased.

Figure 9:
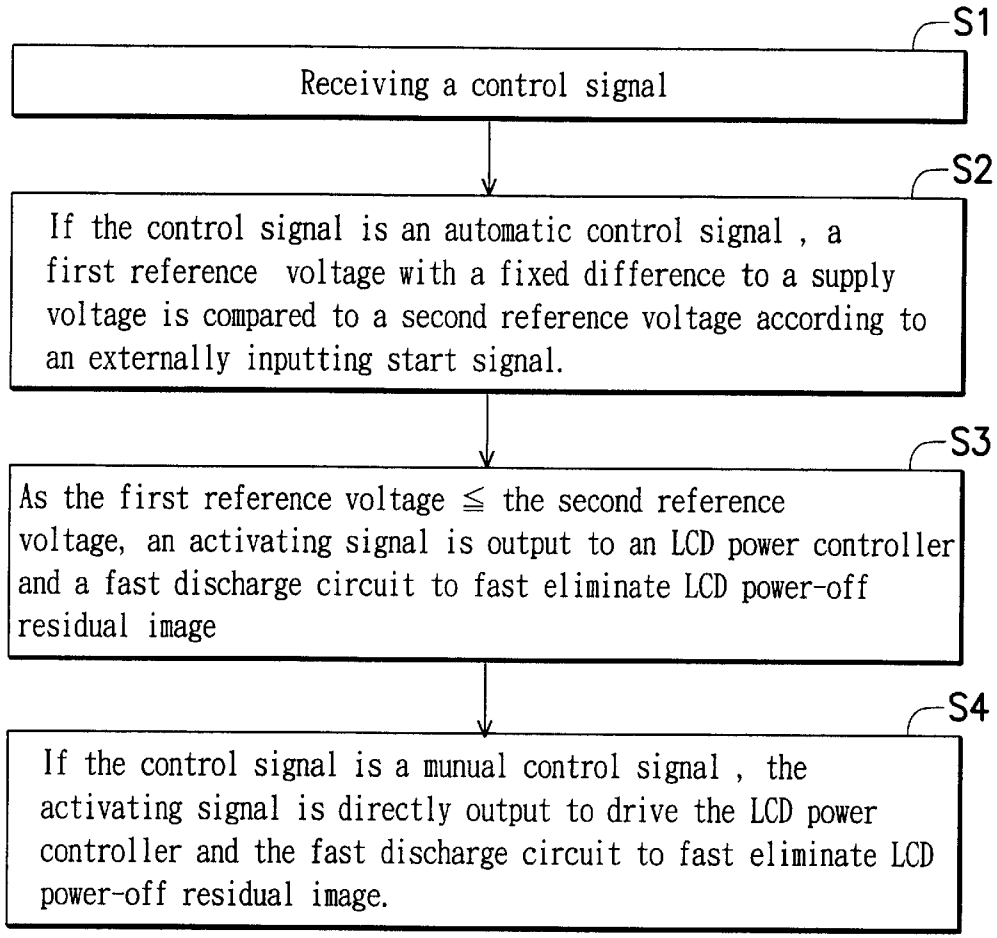
FIG. 9 is a flowchart of the operating method of FIG. 7.

FIG. 9 is the flowchart of FIG. 7. As shown in FIG. 9, the fast-working LCD residual display suppression method includes the following steps. A control signal is received (S1). If the control signal is an automatic control signal, a first reference voltage with a fixed difference to a supply voltage is compared to a second reference voltage according to an externally input start signal (S2). As the first reference voltage≦the second reference voltage, an activating signal is output to an LCD power controller and a fast discharge circuit to quickly eliminate LCD residual display (S3). If the control signal is a manual control signal, the activating signal is directly output to drive the LCD power controller and the fast discharge circuit to quickly eliminate LCD residual display (S4). As such, according to the activating signal, the LCD power controller cuts off the power supply to the fast discharge circuit and combines two discharge paths of the fast discharge circuit to produce an optimal discharge path to speed up the discharge rate. The second reference voltage can be a grounding voltage or a reference voltage from a user.

Although the invention has been described in its preferred embodiment, it is not intended to limit the invention to the precise embodiment disclosed herein. Those who are skilled in this technology can still make various alterations and modifications without departing from the scope and spirit of this invention. Therefore, the scope of the invention shall be defined and protected by the following claims and their equivalents.

What is claimed is:

1. A fast-working LCD residual display suppression method, comprising the steps:

receiving a control signal;

comparing a first reference voltage with a fixed difference to a supply voltage to a second reference voltage according to an externally input start signal if the control signal is an automatic control signal;

outputting an activating signal to an LCD power controller and a fast discharge circuit as the first reference voltage≦the second reference voltage;

directly outputting the activating signal in order to drive the LCD power controller and the fast discharge circuit if the control signal is a manual control signal; and cutting off the power supply to the fast discharge circuit by the LCD power controller according to the activating signal and combining two discharge paths of the fast discharge circuit to produce an optimal discharge path to speed up the discharge rate.

2. The fast-working LCD residual display suppression method of claim 1, wherein the manual control signal is input by a conductive wire connected to an external manually controlled signal input control button.

3. The fast-working LCD residual display suppression method of claim 1, wherein the activating signal is input by a selection switch formed of a logic gate.

4. The fast-working LCD residual display suppression method of claim 1, wherein the two discharge paths respectively have a switch formed of any active device.

5. The fast-working LCD residual display suppression method of claim 1, wherein the optimal discharge path is the smallest impedance of the two discharge paths.

6. The fast-working LCD residual display suppression method of claim 1, wherein the second reference voltage is a grounding voltage.

7. The fast-working LCD residual display suppression method of claim 1, wherein the second reference voltage is a reference voltage from user.

8. A fast-working residual display suppression circuit for LCD comprising:

a manual selector for outputting a manual control signal input externally;

an automatic detection circuit for automatic detection of the powering state and output an automatic control signal;

a selection switch for eliminating residual display and outputting an activating signal according to one of the manual signal and the automatic signal;

a signal level conversion circuit for receiving the activating signal and producing the desired voltage level output;

a fast discharge circuit for quickly eliminating LCD residual display according to the activating signal and the desired voltage level output; and an LCD power controller for cutting off the power supplied to the fast discharge circuit based on the activating signal to speed up the discharge rate.

9. The fast-working residual display suppression circuit for LCD of claim 8, wherein the manual selector is a conductive wire connected to an external manually controlled signal input control button.

10. The fast-working residual display suppression circuit for LCD of claim 8, wherein the automatic detection circuit further comprises:

a detection circuit formed by an OR gate, for outputting a start signal to start the automatic detection circuit under the condition of the entire circuit not powered off and the stable capacitor on the stable state;

a comparator for comparing a first reference from a reference voltage source and a second reference voltage to automatically detect whether or not a power-off action appears; and a one-shot control circuit for outputting an automatic control signal to the selection switch when the first reference voltage is lower than the grounding voltage.

11. The fast-working residual display suppression circuit for LCD of claim 8, wherein the selection switch is an OR gate.

12. The fast-working residual display suppression circuit for LCD of claim 8, wherein the optimal discharge path is the smallest impedance of the two discharge paths.

13. The fast-working residual display suppression circuit for LCD of claim 8, wherein the two discharge paths respectively have a switch formed of any active device.

14. The fast-working residual display suppression circuit for LCD of claim 13, wherein one of the two switches is connected to the output of the signal level conversion circuit and the other is connected to the output of the selection switch.

15. The fast-working residual display suppression circuit for LCD of claim 8, wherein the second reference voltage is a grounding voltage.

16. The fast-working residual display suppression circuit for LCD of claim 8, wherein the second reference voltage is a reference voltage from user.

* * * * *